United States Patent [19]

Beck

[11] 4,372,076

[45] Feb. 8, 1983

[54] MODULAR INTERLOCKING BLOCK CONSTRUCTION TOY

[76] Inventor: Harald Beck, 15 Croxton Ave., Oakland, Calif. 94611

[21] Appl. No.: 49,152

[22] Filed: Jun. 18, 1979

[51] Int. Cl.[3] ..... A63H 33/08

[52] U.S. Cl. ..... 46/20

[58] Field of Search ..... 46/19, 20; 52/233

[56] References Cited

U.S. PATENT DOCUMENTS

| | | | |
|---|---|---|---|
| 1,204,908 | 11/1916 | Schwartz | 46/19 |
| 1,510,326 | 9/1924 | Locke | 46/20 X |
| 2,710,488 | 6/1955 | Schaper | 46/20 X |

FOREIGN PATENT DOCUMENTS

| | | | |
|---|---|---|---|
| 994059 | 8/1951 | France | 46/20 |
| 1068223 | 2/1954 | France | 46/19 |
| 123754 | 12/1927 | Switzerland | 46/19 |

*Primary Examiner*—F. Barry Shay

*Attorney, Agent, or Firm*—Bielen & Peterson

[57] ABSTRACT

A construction toy primarily for children which includes a plurality of logs and flats, the logs and flats being designed on two different primary dimensions such that an expanded variety of model buildings can be erected from the pieces in a modular fashion, the logs being of multiple sizes based on the two primary dimensions and the flats including a variety of full gable pieces, half gable pieces, floor pieces, and roof pieces for select assembly into realistic building structures.

8 Claims, 3 Drawing Figures

MODULAR INTERLOCKING BLOCK CONSTRUCTION TOY

BACKGROUND OF THE INVENTION

This invention relates to a construction toy primarily designed for children but having a complexity that substantially expands the age interest such that it can challenge the design capabilities of adults as well as children. The principal prior art device of this nature has been the toy log set marketed under the trademark Lincoln Logs, which comprised a toy construction set of multiplicity of log pieces based on multiples of a single primary dimension. The number and types of structures that were enabled to be constructed from this prior art device were limited by the single primary dimension on which the design of the toy set was based. Furthermore, while this prior art set did include certain associated pieces for constructing roofs, these pieces were not designed for compatible interlocking with the log pieces.

In devising an interlocking block construction toy having log pieces and compatible flat pieces based on two different primary dimensions, the nature and variety of the structures that can be erected is greatly expanded. Furthermore, the two primary dimensions are based upon the primary dimensions of the triangular shaped full gable for erecting gabled roof structures.

Collateral pieces in addition to the essential logs and flats are included for dressing completed structures. These pieces include roof ridge covers and a chimney piece to provide a finished appearance to the structure erected. Because of the variety and sophistication of the set of pieces in the construction toy, the toy can be used by housing designers in erecting models of modular style cabins, which if erected from logs in the log cabin fashion can be actually constructed using relatively standardized log elements.

SUMMARY OF THE INVENTION

The modular interlocking block construction toy of this invention includes a large plurality of log pieces having length dimensions based on two primary dimensions. The log pieces are either of the first primary dimension, the second primary dimension, or a derivative of the first and second primary dimensions. Short filler log pieces are also included to enable the construction of doors, windows, and the like. In addition, the toy includes a plurality of flat pieces of dimension corresponding to the primary dimensions of the log pieces. The flat pieces comprise compatible elements for log structures designed to include floors, gabled roofs, porches, balconies, garages, sundecks, and the like. The two primary dimensions of the log pieces are based on the configuration of the full gable flat piece which has the configuration of a right isosceles triangle, the two shorter sides forming the base for the shorter primary dimension, and the longer hypotenuse side forming the base for the longer primary dimension.

The modular interlocking block construction toy of this invention is designed for use by a broad age spectrum. It has been found that the construction toy has features of sufficient simplicity to capture the attention and ingenuity of a child of four years in age or younger. Furthermore, the multiplicity and variety of pieces, together with the multiple primary dimension feature discussed heretofore, enables the construction toy to have a sophistication for the interest of an adult for purposes of recreation or serious design. Preferably, the construction toy comprises a set of 180 pieces of 20 different design configurations, enabling construction of almost an infinite number of different structures. The dimensions of virtually all of the pieces are directly interrelated. The systematic design of the interlocking block construction toy is such that there is a rational logic in assembling the pieces with a sufficient number of available options to assist in the development of rational thinking and reasoning in children and adults of all ages. Preferably, for primarily reasons of aesthetics, the interlocking block construction toy is fabricated from quality grain wood. The construction toy is arranged for use in a compartmentalized box container for convenience of access to the pieces and to further aid in the instruction of children by teaching the relationship between orderliness and efficiency. These and other features will become apparent from a detailed consideration of the preferred embodiment.

DETAILED DESCRIPTION OF THE PREFERRED EMBODIMENT

Figure 1:
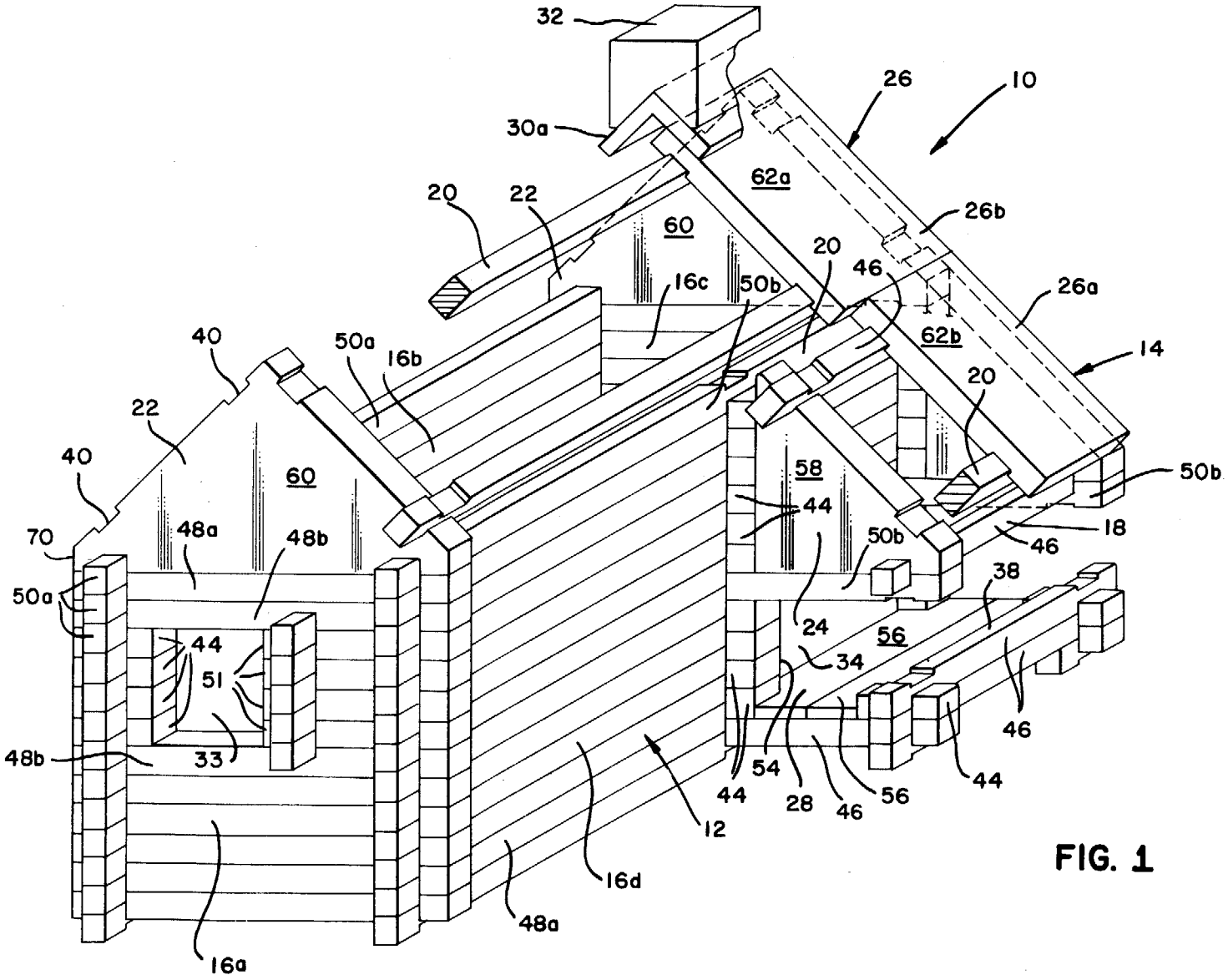
FIG. 1 is a perspective view of an exemplar structure constructed from a toy of this invention.

The modular interlocking-block construction toy comprises a set of block pieces, the majority of which are notched for interlocking connection for the formation of building structures such as the exemplar structure 10 shown in FIG. 1. The exemplar structure 10 comprises a small, substantially completed cabin, which is simple in comparison to the elaborate structures capable of being constructed from this toy. Although simple in construction, the cabin demonstrates the conventional use of the two primary types of pieces which, for convenience, are called logs 12 and flats 14. The logs or log pieces 12 are primarily used to construct walls 16 or to provide the elements for beams 18 and horizontal rafters or purlins 20. The flats or flat pieces 14 are primarily used for roof gables 22, porch or balcony gables 24, roofs 26 and floors 28. Minor auxilliary pieces form a roof ridge 30 and a chimney 32 to provide finish dressing elements for realistic assembled structures.

The simple cabin structure of FIG. 1 has two solid walls **16*b*** and *c*, a wall **16*a* with a window 33, and a fourth wall 16*d* having a doorway 34. The doorway 34 has an entrance or porch platform floor 28 with a protective rail 38 and an overhanging porch roof 26*a*. The cabin 10 has a main roof 26*b* supported by elongated purlins 20. The cabin is capped by a roof ridge cover 30*a* and chimney 32**.

Figure 2:
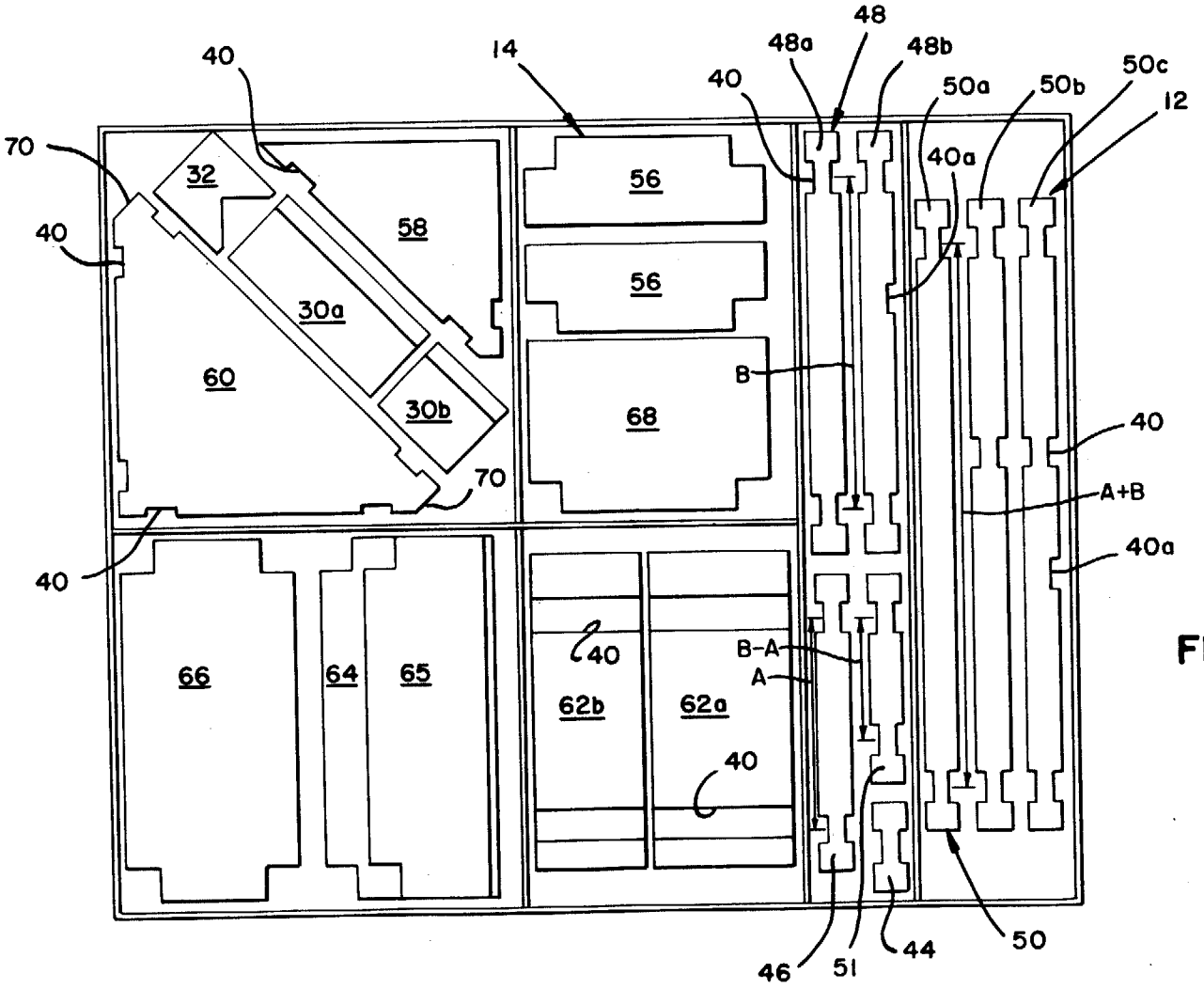
FIG. 2 is a box lay-out for classifying pieces of this toy.

In FIG. 2, a compartmentalized storage box is shown which aids in the description of the pieces utilized in the construction of the structure of FIG. 1. Naturally, a more efficient arrangement can be deviced than that shown which is arranged for the purpose of depicting all pieces with minimal stacking of similar but still different pieces of limited count. The log pieces 12 used in the construction of the exemplar structure of FIG. 1 and shown in FIG. 2 are of five different lengths. Each log has one or more pairs of opposed notches 40. The five log lengths as shown in FIG. 2 comprise a short filler log 44, a medium-short log 46 havin a first primary dimension between the center of notches 40, a medium log 48 having a second primary dimension "A" between the center of notches 40, long logs 50 having a dimension "A+B" between the center of end notches formulated from the sum of the first and second primary dimensions, and short logs 51 having a dimension formulated from the difference of the first and second primary dimensions "B−A". The long logs 50 have three configurations: a first with a pair of notches 40 at each end of the log as in the logs 50*a*; a second with three pairs of opposed notches 40 as shown in the logs 50*b* with the additional opposed notches at the point defined by the first primary dimension and the second primary dimension; and, a third with three pairs of opposed notches 40, and a single notch 40*a*, also defined by the primary dimensions such that the length between the centers of the central opposed notches and the single notch comprises the equivalent length of the short logs 51. The medium logs 48 have two configurations: a first with a pair of opposed notches 40 at each end of the log as in the logs 48*a*; and a second with an additional single notch 40*a* defined by the composite length of the medium-short log 46 and the short log 51 as in the logs 48*b*. The logs having the single notches are used primarily for headers, transoms, threshholds, and sills for forming doors and windows.

The log pieces are primarily used in the formation of the walls 16 of the cabin 10 of FIG. 1 with medium logs 48 in this instance forming side wall 16*c*, a combination of medium logs 48 and short logs 51 forming side wall 16*a*, long logs 50 forming the back wall 16*b*, and a combination of medium logs 48 and long logs 50 forming the front wall 16*d*. The filler logs 44 provide for interlocking at the door jam 54 and window 33. Since the width of the doorway 34 comprises the remaining length of the long log less the middle length log, the porch roof 26*a* covering the doorway 34 is thereby constructed with the medium-short logs 46 as the horizontal beam 18 and purlins 20 shown in FIG. 1.

The variety of flat pieces 14 is also clearly shown in the box arrangement of FIG. 2. With continued reference to FIG. 1, the flat pieces include two butted porch or floor flats 56, which form the porch platform floor 28 of the cabin 10, half gable flats 58 and full gable flats 60 which together with roof flats 62 form the porch roof 26*a* and main roof 26*b* of the cabin structure of FIG. 1.

Other flat pieces shown in FIG. 2, not incorporated in the structure of FIG. 1, are a large wide balcony or floor flat 64, a large narrow balcony of floor flat 65, set on top of floor flat 64 in the box arrangement, and a large porch or floor flat 66, and a second small wide balcony floor flat 68. The floor flats have either notches on four sides as in floor flats 66 and 56 (when butted together in combination), which are utilized for floors having interlocking constructions that continue around them, or, have only two corner notches, as in balcony floor flats 64 and 68 which are used as balcony floors or flat roofs with generally no further construction above or around the flat. The terms "balcony" or "porch" are used only as handy identifiers relating to the principle use of the pieces, but by no means limit the actual varietal use of the pieces. The dress pieces, forming the roof ridge 30 comprising the long roof ridge cover 30*a* and the short roof ridge cover 30*b*, together with the chimney 32 complete the set.

In the preferred set of pieces for the modular interlocking block construction toy, the number of pieces of each type has been found to provide versatile construction within reasonable limits. Naturally, doubling of sets of adding more pieces will add to the construction possibilities.

PIECES IN EXEMPLAR SET OF PREFERRED EMBODIMENT

| Description | Ref. No. | No. of Pieces |
|---|---|---|
| 2 Notch long logs | 50 a | 5 |
| 3 Notch long logs | 50 b | 26 |
| 3½Notch long logs for doors/windows | 50 c | 4 |
| 2 Notch Medium logs | 48 a | 35 |
| 2½Notch medium logs for doors/windows | 48 b | 4 |
| Medium-Short logs | 46 | 16 |
| Short logs | 51 | 12 |
| Filler logs | 44 | 50 |
| Main roof gable flats | 60 | 2 |
| Half roof gable flats | 58 | 2 |
| Small butted porch flats | 56 | 2 |
| Small balcony or floor flat | 68 | 1 |
| Large porch flat wide | 64 | 1 |
| Large floor flat narrow | 65 | 1 |
| Large balcony floor flat | 66 | 1 |
| Wide roof flats | 62 a | 6 |
| Narrow roof flats | 62 b | 7 |
| Long roof ridge cover | 30 a | 3 |
| Short roof ridge cover | 30 b | 1 |
| Chimney | 32 | 1 |

Figure 3:
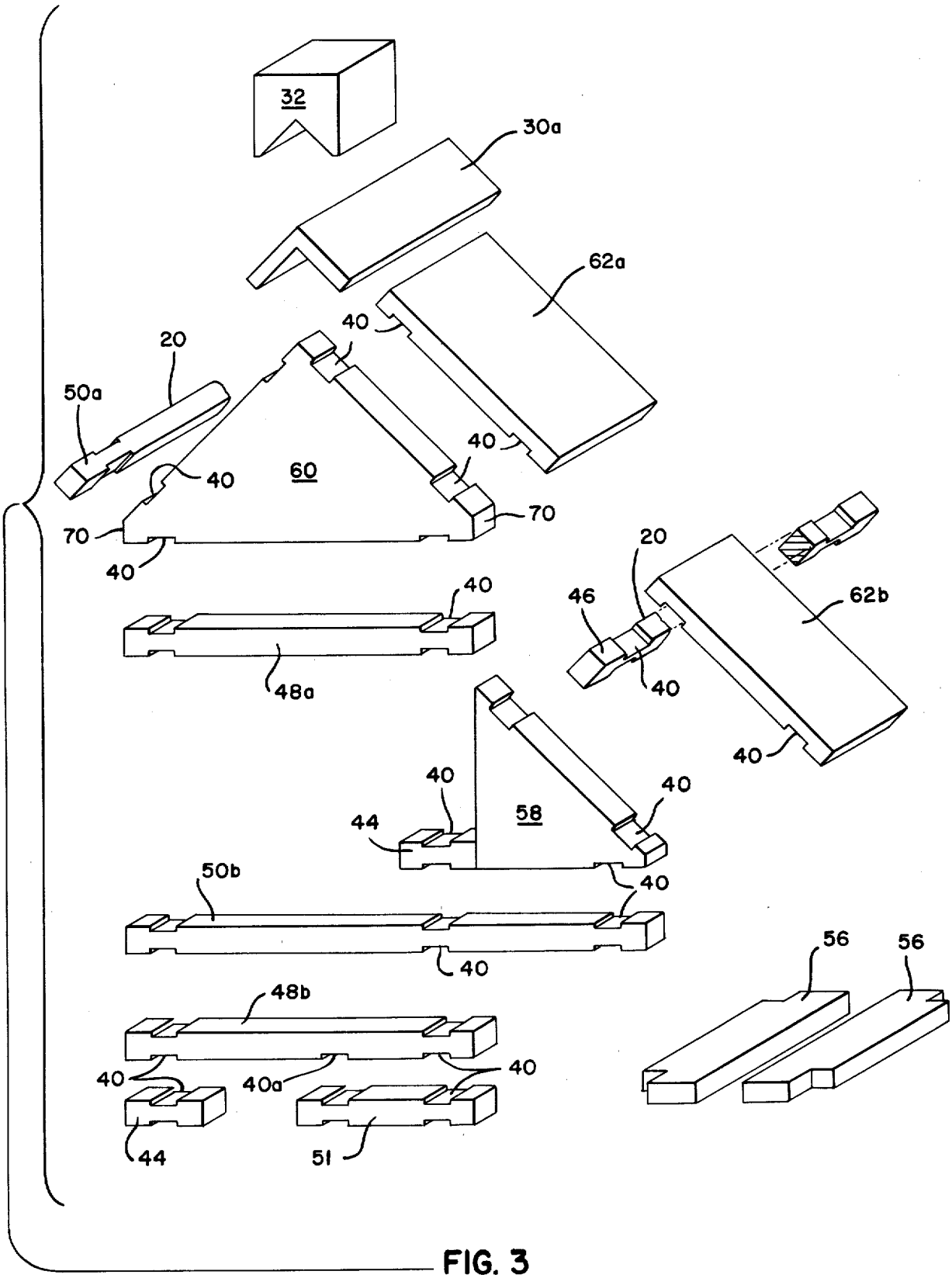
FIG. 3 is an exploded view of certain pieces in the exemplar structure of FIG. 1.

Referring now to FIG. 3, the dimension interrelationship of the pieces can be further appreciated. The exploded view of FIG. 3 includes some, but by no means all, of the pieces in the representational portion of the cabin structure of FIG. 1.

The key piece in the set of block pieces of the modular interlocking block construction toy comprises the full roof gable flat 60. The roof gable flat 60 is constructed in the general configuration of a right isosceles triangle. The hypotenuse opposite the right angle, is used as the basis for defining the second primary dimension. The second primary dimension is the length between the two notches 40 on the horizontal span of the roof gable flat. The first primary dimension comprises the shorter length between the two notches 40 on each of the two sides defining the right angle of the roof gable flat. It has been found that keying the two primary dimensions to an integral piece in the toy set vastly expands the number of innovative structures that can be erected.

In the preferred embodiment the horizontal base span of the full roof gable flat 60 is selected as approximately six inches. The resultant structures are of reasonable size and the pieces are easy to handle. The two ends 70 of the gable flat 60 are bobbed to eliminate the acute apex angle otherwise formed. Furthermore, this provides an added strength to the ends of the roof gable which are somewhat weakened by inclusion of the notches 40. The distance between the notches and the end of the roof gable is selected as a standard dimension incorporated into the various logs, as the dimension from the notches 40 in the logs to the respective ends of the logs. While this end dimension is also incorporated at one end of roof cover flat 62*a* as shown in FIG. 3, the lower end of the roof cover flat illustrated therein has a somewhat longer dimension in order to provide a more realistic overlapping of the roof cover flats with respect to the roof gable flat and hence the side walls of the structure. This further provides an overlap step when a porch or balcony roof is erected with the half gable flats 58 and roof cover 62*b* oriented in a reverse manner immediately below the eave of the main roof as is demonstrated in FIGS. 1 and 3.

This feature also adds a variation in the piece configuration that multiplies the options for the user. For example, the roof cover in the front of the structure could overlap with the longer end segment oriented downwardly whereas the roof cover for the back of the roof structure could be oppositely oriented with the longer segment oriented upwardly and overlapping the butt end of the front roof cover to provide a pointed roof structure for which the roof ridge cover can be eliminated. Normally, however, roof cover flats are covered by the roof ridge such as the long roof ridge cover 30*a* shown in FIG. 3. The chimney 32 normally tops a structure.

As mentioned, the medium logs 48 are based on the second primary dimension obtained from the roof gable flat 60. The medium short logs 46 are similarly based on the first primary dimension obtained from said gable flat. The short logs 51 are based on the difference between the medium logs 48 and the medium-short logs 46. The long logs 50 are based on the summation of the first primary dimension and the second primary dimension. The filler logs 44 are comprised of the fixed notch dimension, which equals the width of the various pieces, and the two set end dimensions also originated from the key roof gable flat 60 as the dimension from the notch 40 to the ends 70.

The half gable flat 58 as shown in FIG. 3 is designed for use with the medium-short logs 46 or the short segment of a three notch pair, long log 50*b* as shown in FIG. 3. Both roof gable flats are designed to receive purlins 20 for support of the roof covers 62*a* and 62*b*. The two butted porch floor segments 56 are designed on the basis of the shorter primary dimension and when used together have four notches in each corner such that an auxilliary structure or railing can be erected around the floor. The medium log 48*b* has the single notch 40*a* allowing cooperation with the short log 51 for formation of a wall with a window.

While the particular pieces have been defined with relation to certain specific uses, it will be found that with the variety of construction choices available from the coordinated dimensioning of the pieces, many pieces can be used for other than their primary use. It would not be uncommon to find roof covers being used as floors or flat decks and for other innovative uses to be found for other pieces. The resultant structures are so well interlocked that they can be moved as a whole by proper handling without the use of a rigid support surface under the structure.

While in the foregoing specification embodiments of the invention have been set forth in considerable detail for the purposes of making a complete disclosure of the invention, it will be apparent to those skilled in the art that numerous changes may be made in such details without departing from the spririt and principles of the invention.

What is claimed is:

1. A modular interlocking block construction toy comprising:

a plurality of elongated logs of substantially uniform cross section forming a set, each log having opposed notches for interconnecting said logs by mutually interfacing of notches of separate logs to form relatively rigid structures, wherein a first plurality of said logs in said set have at least two pairs of notches spaced apart by a first primary dimension, and a second plurality of said logs in said set have at least two pairs of notches spaced apart by a second primary dimension;

a plurality of flats formed of flat block pieces having notches spaced for cooperation with said logs, wherein said flats include a key gable flat defining said primary dimensions, said gable flat having a triangular configuration with a bottom edge and two equal side edges at an acute angle to said bottom edge, said bottom edge having two spaced notches spaced apart a distance comprising said second primary dimension and said side edges each having two spaced notches spaced apart a distance comprising said first primary dimension wherein said second primary dimension is greater than said first primary dimension.

2. The construction toy of claim 1 wherein said flats include a roof flat having faces, one face having two spaced notches spaced by said first primary dimension.

3. The construction toy of claim 2 wherein said two spaced notches on the face of said roof flat are asymmetrically off-set from a centerline on the face of said flat wherein upon assembly on a roof support for a structure, a portion of the roof overhangs the structure.

4. The construction toy of claim 1 including long logs having two pairs of opposed notches spaced by a sum of said two primary dimensions.

5. The construction toy of claim 4 wherein said long logs include at least one additional notch between said two pairs of spaced notches with a spacing from said opposed notches based on said two primary dimensions.

6. The construction toy of claim 1 including short logs having two pairs of opposed notches with a spacing based on the difference between said two primary dimensions.

7. The construction toy of claim 6 wherein certain of said logs have at least one additional notch, with a spacing from at least one pair of opposed notches equivalent to said short legs.

8. The construction toy of claim 1 wherein a further plurality of logs in said set have notches spaced apart a derivative combination of said first and second primary dimensions.

* * * * *